US009475066B2

(12) United States Patent
Grossmann et al.

(10) Patent No.: US 9,475,066 B2
(45) Date of Patent: Oct. 25, 2016

(54) FLOTATION APPARATUS AND FLOTATION METHOD

(75) Inventors: Lilla Grossmann, Erlangen (DE); Wolfgang Krieglstein, Nuremberg (DE)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 334 days.

(21) Appl. No.: 13/883,378

(22) PCT Filed: Oct. 28, 2011

(86) PCT No.: PCT/EP2011/068937

§ 371 (c)(1),
(2), (4) Date: May 3, 2013

(87) PCT Pub. No.: WO2012/059415

PCT Pub. Date: May 10, 2012

(65) Prior Publication Data

US 2013/0220894 A1 Aug. 29, 2013

(30) Foreign Application Priority Data

Nov. 3, 2010 (EP) ..... 10189809

(51) Int. Cl.

| | |
|---|---|
| ***B03D 1/24*** | (2006.01) |
| ***B03D 1/16*** | (2006.01) |
| ***B03D 1/02*** | (2006.01) |
| ***B03D 1/22*** | (2006.01) |

(Continued)

(52) U.S. Cl.

CPC ..... *B03D 1/02* (2013.01); *B03D 1/1406* (2013.01); *B03D 1/1456* (2013.01); *B03D 1/1493* (2013.01); *B03D 1/20* (2013.01); *B03D 1/22* (2013.01); *B03D 1/24* (2013.01); *B03D 1/247* (2013.01); *B03D 1/1418* (2013.01); *B03D 1/1475* (2013.01); *B03D 1/16* (2013.01)

(58) Field of Classification Search

None

See application file for complete search history.

(56) References Cited

U.S. PATENT DOCUMENTS

| | | | | |
|---|---|---|---|---|
| 2,189,779 A | | 2/1940 | Daman | 209/168 |
| 3,371,779 A | * | 3/1968 | Hollingsworth | B01F 5/0212 209/166 |

(Continued)

FOREIGN PATENT DOCUMENTS

| | | | |
|---|---|---|---|
| CN | 2224031 Y | 4/1996 | B03D 1/02 |
| CN | 2227985 Y | 5/1996 | |

(Continued)

OTHER PUBLICATIONS

International Search Report and Written Opinion, Application No. PCT/EP2011/068937, 26 pages, Feb. 9, 2012.

(Continued)

*Primary Examiner* — Thomas M Lithgow

(74) *Attorney, Agent, or Firm* — Slayden Grubert Beard PLLC

(57) ABSTRACT

A flotation apparatus may include a flotation chamber having a side wall and a base, a stirrer, a sparging device associated with the stirrer, a first foam-collecting device arranged in an upper region of the flotation chamber for the purpose of collecting a foam product formed during the flotation process, and a charge line for charging the flotation chamber with pulp, wherein the charge line leads into the flotation chamber at a point above the stirrer and an ejector is present in the charge line. Further, a flotation method is performed in two stages inside a flotation chamber of a flotation apparatus, wherein an ejector is used in a first flotation stage and a stirrer is used in a second flotation stage.

17 Claims, 4 Drawing Sheets

(51) Int. Cl.

| | |
|---|---|
| ***B03D 1/20*** | (2006.01) |
| *B03D 1/14* | (2006.01) |

(56) References Cited

U.S. PATENT DOCUMENTS

| | | | | | |
|---|---|---|---|---|---|
| 4,094,783 | A * | 6/1978 | Jackson | B01D 17/0205 | 210/197 |
| 4,612,113 | A | 9/1986 | Kallioinen | | 209/170 |
| 4,746,440 | A * | 5/1988 | Seeger | B01D 17/0205 | 209/169 |
| 5,470,465 | A * | 11/1995 | Moorehead et al. | | 210/205 |
| 5,616,240 | A * | 4/1997 | Sonnenrein | | 210/104 |
| 5,672,267 | A * | 9/1997 | Terblanche | B03D 1/1468 | 209/164 |
| 6,056,125 | A * | 5/2000 | Lai et al. | | 209/164 |
| 6,991,111 | B2 * | 1/2006 | Lilja et al. | | 209/169 |
| 2005/0242000 | A1 * | 11/2005 | Khan et al. | | 209/164 |
| 2010/0300953 | A1 | 12/2010 | Aver | | 210/242.2 |
| 2012/0218852 | A1 | 8/2012 | Becker et al. | | 366/101 |

FOREIGN PATENT DOCUMENTS

| | | | | |
|---|---|---|---|---|
| CN | 201088935 | Y | 7/2008 | B03D 1/14 |
| CN | 101680164 | A | 3/2010 | D21B 1/32 |
| DE | 1017553 | B | 10/1957 | B03D 1/16 |
| DE | 1279573 | B | 10/1968 | B03D 1/16 |
| DE | 3312070 | A1 | 10/1984 | B03D 1/14 |
| EP | 2308601 | A1 | 4/2011 | B01F 3/04 |
| RU | 2121884 | C1 | 11/1998 | B03D 1/24 |
| SU | 1563582 | A3 | 5/1990 | B03D 1/14 |
| SU | 1717238 | A1 | 3/1992 | B03D 1/14 |
| WO | WO03/055608 | A1 * | 7/2003 | |
| WO | 2008/139289 | A2 | 11/2008 | B03D 1/18 |
| WO | 2012/059415 | A1 | 5/2012 | B03D 1/14 |

OTHER PUBLICATIONS

Chinese Office Action, Application No. 201180052681.0, 14 pages, Mar. 18, 2014.

Russian Office Action, Application No. 2013125233/03, 5 pages, Sep. 24, 2015.

* cited by examiner

FLOTATION APPARATUS AND FLOTATION METHOD

CROSS-REFERENCE TO RELATED APPLICATIONS

This application is a U.S. National Stage Application of International Application No. PCT/EP2011/068937 filed Oct. 28, 201, which designates the United States of America, and claims priority to EP Patent Application No. 10189809.6 filed Nov. 3, 2010 The contents of which are hereby incorporated by reference in their entirety.

TECHNICAL FIELD

The disclosure relates to a flotation apparatus having a stirrer as dispersion device and to a flotation method. A flotation apparatus known for example from DE 1 279 573 comprises a flotation chamber bounded by a sidewall and a base, a pulp infeed, a stirrer, an aeration device associated with the stirrer, and a foam-collecting device arranged in an upper region of the flotation chamber for the purpose of collecting a foam product formed during the flotation process.

BACKGROUND

Flotation is a physical separation method for separating a mixture of particles on the basis of differences in the particles' surface wettability. In such a method, utilized for example for separating ore minerals and gangue, a gas such as air or nitrogen is introduced with the aid of the aeration device into the particle mixture that is present in the form of an aqueous suspension, the pulp. In addition flotation chemicals for hydrophobizing the surface of the valuable particles, in other words the ore particles in the case of a crude ore, are added to the pulp. The gas bubbles present in the pulp adhere to the hydrophobic particles, thereby producing adducts, also called aeroflocs, which rise to the surface and accumulate as a foam product on the pulp and can be discharged from there.

In order to enable aeroflocs to form it is necessary to induce turbulences in the pulp with the aid of a mixing device, the aforementioned stirrer, so that the gas will be dispersed in the pulp and collisions are able to take place between gas bubbles and particles. However, not every collision leads to the formation of an aerofloc. Thus, forming an adduct from a small gas bubble with a small particle requires a collision taking place with relatively high kinetic energy, i.e. the particle must be accelerated to a high velocity by the mixing device. To achieve this with a stirrer, however, would necessitate at best high expenditure of energy and high material attrition, which would make the flotation process uneconomic. Flotation apparatuses with stirrer as mixing device are therefore operated with lower input of energy in such a way that the hydrodynamic conditions that become established favor the separation of particle fractions having diameters that are larger on average. Due to a lack of sufficient kinetic energy finer particles in this case form at best adducts on a smaller scale and remain behind in the residual pulp. In order to recover the fine fraction of the particles the residual pulp is conventionally treated further in other downstream flotation apparatuses, which is associated with corresponding process engineering and equipment overhead.

SUMMARY

One embodiment provides a_flotation apparatus comprising a flotation chamber having a sidewall and a base and serving to contain a pulp, a foam-collecting device arranged in an upper region of the flotation chamber for the purpose of collecting a foam product formed during the flotation process, and a charge line for continuously charging the flotation chamber with pulp, wherein the charge line leads into the flotation chamber at a point located above the stirrer, wherein for the purpose of dispersing a gas in the pulp a first mixing device is present in the charge line and a second mixing device comprising a stirrer and a sparging device associated with the stirrer is present inside the flotation chamber.

In a further embodiment, a plurality of charge lines equipped with a first mixing device are present which are arranged on the flotation chamber in a mutually spaced relationship in the circumferential direction.

In a further embodiment, the sidewall of the flotation chamber has a circular cross-sectional shape.

In a further embodiment, an end section of the charge line connected to the flotation chamber is aligned tangentially with respect to the sidewall.

In a further embodiment, an inner chamber having a cylindrical sidewall and being open at top and bottom is arranged centrally in the flotation chamber with a radial clearance from the sidewall of the flotation chamber while leaving an annular space free.

In a further embodiment, a foam-collecting device arranged in an upper region of the inner chamber is present.

In a further embodiment, the charge line leads into the annular space.

In a further embodiment, the charge line leads into the inner chamber.

In a further embodiment, the inner chamber is height-adjustable.

In a further embodiment, a baffle with adjustable baffle opening is present at the lower end of the inner chamber.

In a further embodiment, the stirrer is encompassed laterally by a deflector plate which is in the form of a funnel opening toward the top and which covers a corner region of the flotation chamber formed by the lower end of the sidewall and the base.

In a further embodiment, the foam-collecting device is a collecting tank encompassing the flotation chamber or the inner chamber with a radial clearance.

In a further embodiment, the first mixing device is an ejector.

Another embodiment provides a flotation method which is performed in two flotation stages inside a pulp-containing flotation chamber of a flotation apparatus, wherein the dispersion of a gas in the pulp is accomplished with the aid of a first mixing device arranged inside a charge line serving to feed pulp into the flotation chamber in the first flotation stage and with the aid of a second mixing device comprising a stirrer and a sparging device associated therewith in the second flotation stage.

In a further embodiment, such flotation method is performed using a flotation apparatus as disclosed above.

BRIEF DESCRIPTION OF THE DRAWINGS

Exemplary embodiments will be explained in more detail below based on the schematic drawings, wherein.

DETAILED DESCRIPTION

Figure 1:
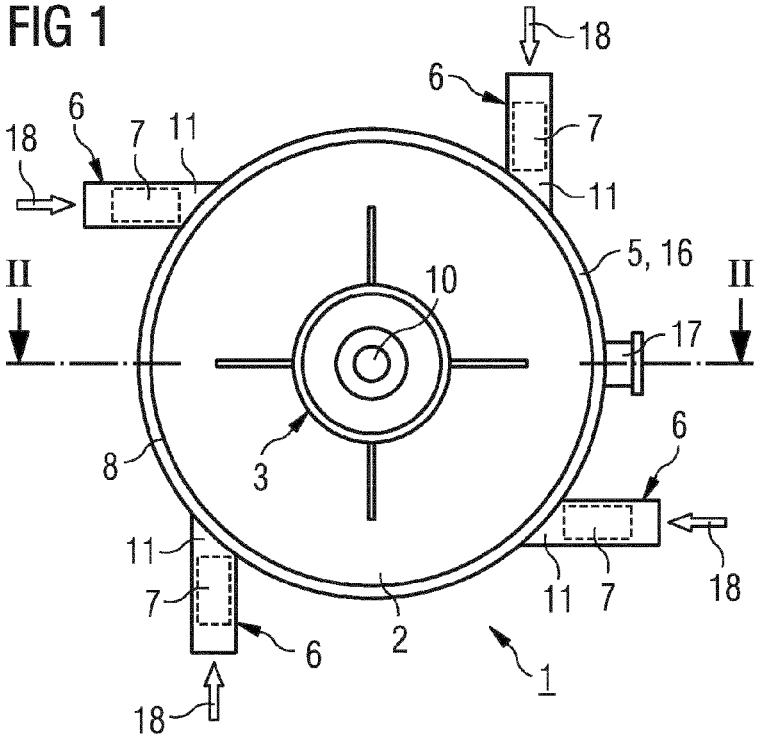
FIG. 1 shows a cross-section of a flotation apparatus corresponding to line I-I in FIG. 2.
Figure 2:
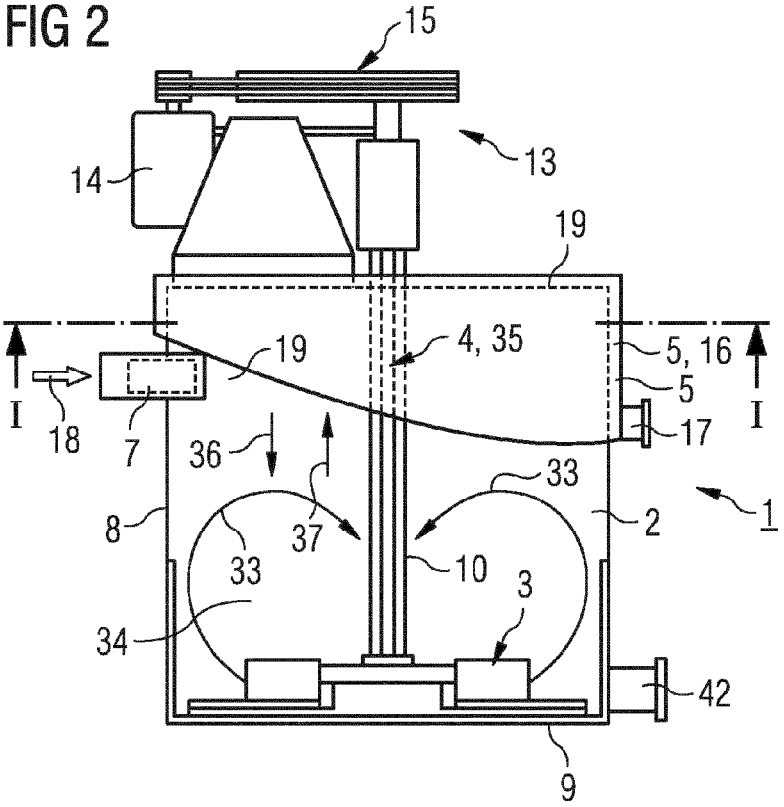
FIG. 2 shows a longitudinal section through the flotation apparatus corresponding to the line II-II in FIG. 1.

Embodiments of the present disclosure provide a flotation apparatus with stirrer and a flotation method which enable a flotation with improved yield.

For example, in some embodiments a flotation apparatus comprises a flotation chamber having a sidewall and a base and serving to contain a pulp, a foam-collecting device (5, 5*a*) arranged in an upper region of the flotation chamber for the purpose of collecting a foam product formed during the flotation process, and a charge line (6) for continuously charging the flotation chamber with pulp. The charge line leads into the flotation chamber at a point located above the stirrer. For the purpose of dispersing a gas in the pulp a first mixing device (M1) is present in the charge line and a second mixing device (M2) comprising a stirrer (3) and a sparging device (4) associated with the stirrer (3) is present in the flotation chamber (2).

Other embodiments provide a method in which the flotation is performed in two flotation stages inside a flotation chamber containing a pulp within a flotation apparatus, wherein a gas is dispersed in the pulp with the aid of a first mixing device arranged inside a charge line serving to feed pulp into the flotation chamber in the first flotation stage, and with the aid of a second mixing device comprising a stirrer and a sparging device (4) associated with said stirrer in the second flotation stage.

In some embodiments two mixing devices operating essentially independently of each other are present, by means of which a gas in the form of gas bubbles and particles can be dispersed in the pulp under high turbulence. In the process the respective turbulence zones are spatially separated from one another in such a way that mutual influencing of the adducts forming there due to the prevailing hydrodynamic conditions is practically excluded. It is therefore possible to realize a two-stage flotation process within one and the same flotation chamber, wherein the first flotation stage comprises one or more first mixing devices and the second flotation stage comprises the stirrer and its associated sparging device. Different hydrodynamic conditions can be created in the respective turbulence zones, thus affording the possibility in principle to recover different particle fractions simultaneously in one flotation apparatus and/or by means of a flotation method performed in a single flotation apparatus or, as the case may be, in the flotation chamber of the same. It is therefore possible to convert particles having a wider range of sizes into the foam product than in the case of the known flotation apparatus, with the result that proportionally higher yields can be achieved and subsequent flotation steps are rendered unnecessary or necessary only on a reduced scale.

An ejector may be employed as the first mixing device. Ejectors are known per se in the field of flotation technology and are described for example in European patent application no. EP 09171568.0. In this case the ejector is, as will be explained in more detail further below, an apparatus for dispersing a gas in a pulp, comprising—viewed sequentially in the flow direction of the suspension—a suspension nozzle tapering in the flow direction, a mixing chamber into which the suspension nozzle leads, and a mixing tube adjoining the mixing chamber and tapering in the flow direction. Also present is a gas supply line for feeding a gas into the mixing chamber. A large volume of gas can be introduced into the pulp with the aid of an ejector and distributed in the form of very many, predominantly small, gas bubbles. This increases the frequency of particle-bubble collisions, resulting in the formation of mainly adducts composed of small bubbles and particles tending to be of smaller size. The adducts rise upward in the flotation chamber without passing into the turbulence zone of the stirrer and being exposed to the danger of disintegrating again due to collision with a particle. Rather, they can float to the surface practically without a detrimental effect of said kind and be discharged with the aid of a foam-collecting device, e.g., a foam-collecting tank encompassing the flotation chamber with a radial clearance. Heavier particles which encounter rather unfavorable hydrodynamic conditions for forming aeroflocs in the ejector and consequently after passing through the ejector or after the pulp has entered the flotation vessel have not formed any aeroflocs sink toward the bottom and are caught up by the turbulence zone of the stirrer in which hydrodynamic conditions are present which favor the formation of particle-bubble adducts composed of larger bubbles and larger particles.

The flotation apparatus 1 shown in the diagrams according to FIGS. 1-6 comprise a flotation chamber 2, a foam-collecting device 5 and four charge lines 6 arranged around the flotation chamber 2 in a mutually spaced relationship in the circumferential direction, each of which charge lines includes a first mixing device M1 in the form of an ejector 7 or into which charge lines such an ejector is integrated. A second mixing device M2 comprising a stirrer 3 and a sparging device 4 associated with the stirrer 3 is arranged in the flotation chamber 2. The flotation chamber 2 is bounded by a sidewall 8 having a circular cross-sectional shape and a base 9. The stirrer 3, embodied for example as a stator-rotor system, is arranged on the base 9 of the flotation chamber 2 or in the lower region thereof. It is connected by way of a hollow shaft 10 to a drive unit 13 comprising for example an electric motor 14 and a gearing mechanism 15 connecting said motor to the hollow shaft. The foam-collecting device 5 is embodied as a foam-collecting tank 16 which encompasses the sidewall 8 with a radial clearance and on which a discharge port 17 is present for discharging a foam product. The ejectors 7 collectively form a first flotation stage, and the stirrer 3 together with the associated sparging device 4 forms a second flotation stage.

The charge lines 6 are arranged on the sidewall 8 of the flotation chamber 2 such that their end section 11 connected to the flotation chamber 2 and/or the flow direction 18 of a pulp flowing through the end sections 11 extend tangentially with respect to the flotation chamber 2 or to its cylindrical sidewall 8. The charge lines 6 lead into the flotation chamber 2 at a point 19 disposed above the stirrer 3 close to the upper edge 19 of the sidewall 8. A vertical distance is therefore present between the outlet of the charge lines 6 and the stirrer 3.

Figure 7:
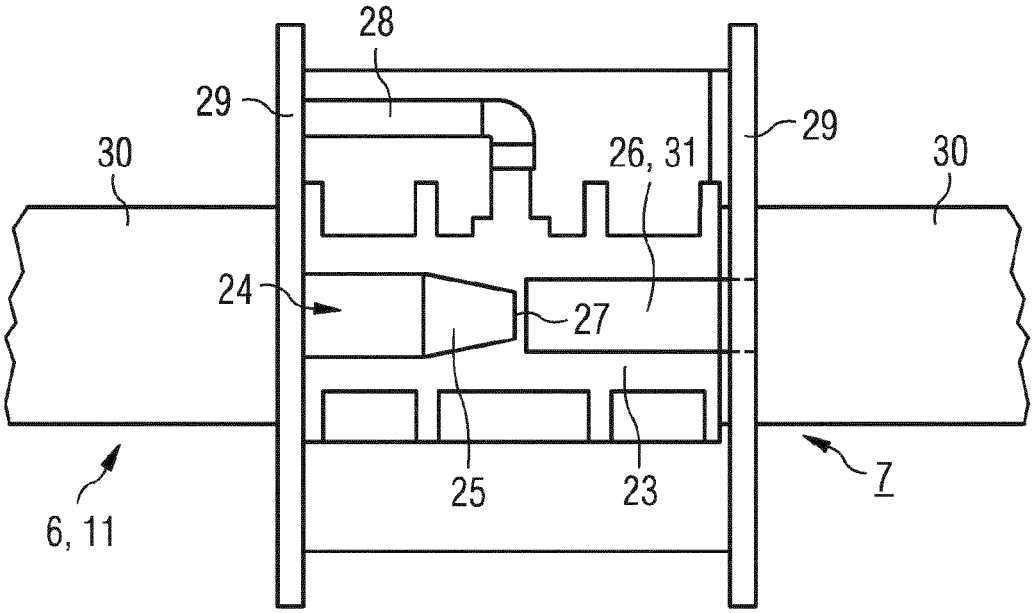
FIG. 7 shows a longitudinal section through an ejector.

An ejector 7 comprises as essential component a nozzle, referred to hereinbelow as a suspension nozzle 25, from the outlet orifice of which the pulp is ejected at high velocity, a gas being introduced in the outlet region or, as the case may be, being ingested on account of a negative pressure that is present there. The gas enters the pulp stream exiting the suspension nozzle and is dispersed therein in the form of fine gas bubbles. The injector 7 represented schematically in FIG. 7 has a tubular housing 23 which is traversed by a cavity 24 in the longitudinal or axial direction. A section of the cavity 24 on the inlet side is embodied as a suspension nozzle 25 tapering in the flow direction of a pulp streaming through the ejector 7. Adjoining the suspension nozzle 25 is a mixing chamber 26 which is embodied for example in the manner of a cylindrical borehole. An aperture 27 is present between the suspension nozzle 25 and the mixing chamber 26. A gas, air or nitrogen for example, can be supplied to the pulp through said aperture 27 by way of a gas line 28. The gas passes into the mixing chamber 26. Due to the effect of the suspension nozzle there is formed in the mixing chamber 26 a turbulence zone 31 in which the gas in the form of predominantly small gas bubbles collides with particles of the pulp. A flange 29 is present in each case on the inlet side and on the outlet side of the ejector 7, a tube section 30 which is part of the charge line 6 being attached to a flange 29.

The above-described flotation apparatus 1 operates as follows: The flotation chamber 2 is filled with an aqueous pulp, for example a crude ore suspension. The rotating stirrer 3 of the second flotation stage creates a turbulence zone 34 indicated by the arrows 33. A gas is introduced into the flotation chamber 2 by way of the sparging device 4, which is formed substantially by the interior 35 of the hollow shaft 10 which is open at its bottom end, with gas bubbles being dispersed in the pulp, in particular in the turbulence zone 34, due to the rotational movement of the stirrer 3. A similar dispersion, albeit of smaller gas bubbles on average, takes place in the ejectors 7 of the first flotation stage. There, aeroflocs form from said gas bubbles and rather smaller particles. Said aeroflocs float to the top and accumulate as foam product in the foam-collecting tank 16, from which they are discharged by way of the discharge port 17. In contrast, heavier particles to which no gas bubble has adhered in the ejectors 7, sink toward the bottom—as indicated by the arrow 36—and enter the turbulence zone 34 of the stirrer 3. Corresponding collision events between particles and gas bubbles lead in turn to the formation of aeroflocs, though in this case such composed of larger particles and larger gas bubbles, which rise upward (indicated by the arrow 37) and likewise arrive as foam product in the foam-collecting tank 16. Because the turbulence zone 31 of the ejectors 7, which essentially corresponds to the mixing chamber 26 of an ejector 7, is arranged outside the flotation chamber 2 or separated off from the latter, aeroflocs ascending from the region of the stirrer 3 cannot pass into said zone, in which they could be destroyed again due to collision with high-energy particles.

In order for the ejectors 7 to be able to operate effectively they must always have passing through them a pulp stream which is sufficiently voluminous to ensure the hydrodynamic conditions necessary for forming aeroflocs. With this object in view it is beneficial if a return line 32 is provided which branches off from an outlet 42 serving to discharge residual pulp from the flotation chamber 2 and leading into at least one charge line 6. Part of the residual pulp stream can be ducted into an ejector 7 by way of the return line if it becomes necessary to restrict the supply of pulp for process control reasons.

Figure 3:
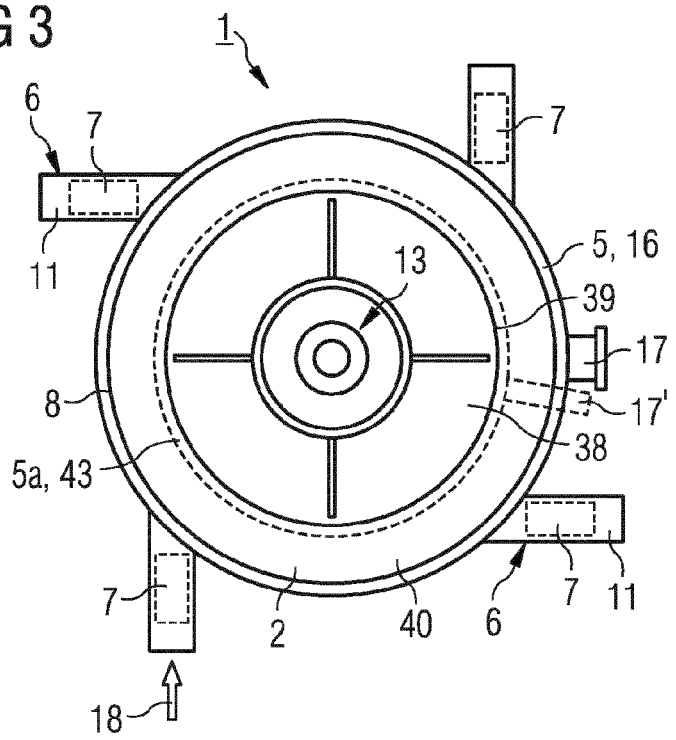
FIG. 3 shows in a view corresponding to FIG. 1 a flotation apparatus in the flotation chamber of which an inner chamber is present.
Figure 4:
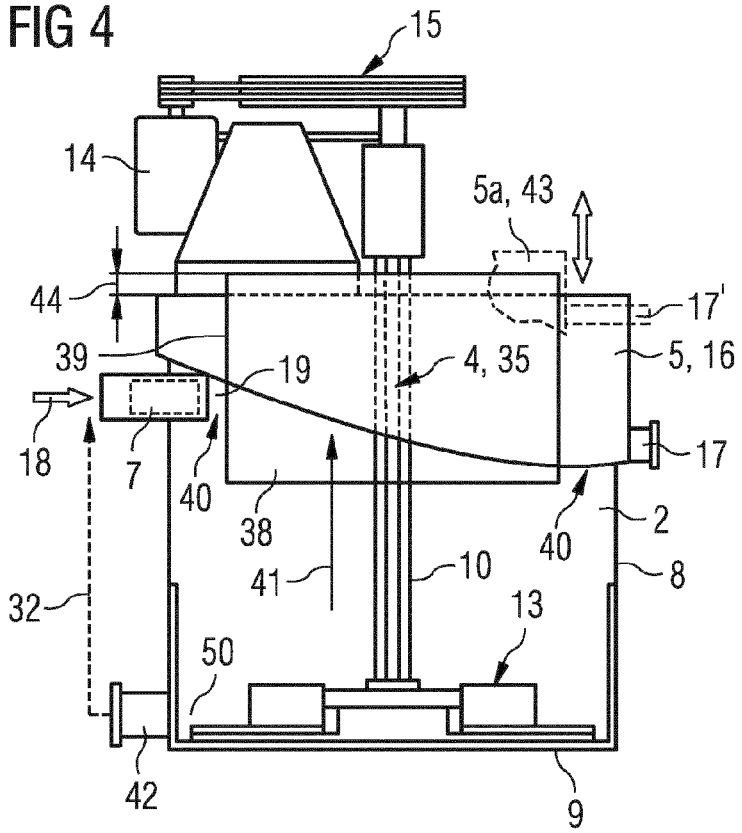
FIG. 4 shows the flotation apparatus of FIG. 3 in a view corresponding to FIG. 2.

The flotation chamber 2 of the flotation apparatus 1 shown in FIGS. 3 and 4 has an inner chamber 38. This is bounded by a cylindrical sidewall 39 and is open at top and bottom. The inner chamber 38 can also be bounded by a sidewall 39 of different design, likewise open at the bottom, for example one tapering conically toward the bottom. The bottom opening is dimensioned in this case such that the hollow shaft 10 can pass contactlessly through. It is arranged centrally in the flotation chamber 2 with a radial clearance from the sidewall 8 while leaving an annular space 40 free. The inner chamber 38 is equipped with a foam-collecting device 5*a* which is embodied as a foam-collecting tank 43 encompassing the upper end of the sidewall 39 with a radial clearance. For the purpose of discharging a foam product the foam-collecting tank 43 is provided with a discharge port 17'. The inner chamber 38 protrudes by a projecting end 44 out of the flotation chamber 2 or, as the case may be, out of the foam-collecting tank 16 encompassing the same. The effect of the inner chamber 38 is that at least some of the aeroflocs ascending from the turbulence zone 34 of the stirrer 3 (see arrow 41) have to travel shorter distances to the discharge port 17', thereby shortening their residence time inside the flotation chamber 2 or the foam-collecting tank 43 and consequently reducing the probability of their disintegration. Without inner chamber 38 the aeroflocs would be entrained by the circular flow of the pulp streaming tangentially into the flotation chamber by way of the charge lines 6, with the result that they would have to travel substantially longer distances. Although the aeroflocs formed in the ejectors 7 are captured by the said circular flow, because the end sections 11 of the charge lines 6 lead into the flotation chamber 2 far above at the points 19, the distance traveled by the aeroflocs to the discharge port 17 is shorter from the outset. Furthermore, their room for movement is limited to the annular space 40 which is present between the inner chamber 38 and the sidewall 8 and into which the pulp flows.

Figure 5:
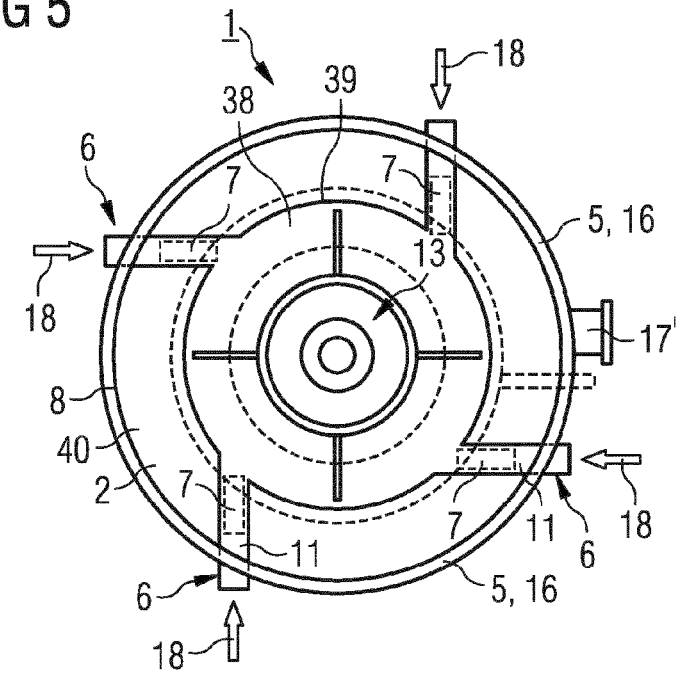
FIG. 5 shows a modified form of the flotation apparatus of FIG. 3 in a view corresponding to FIG. 1.
Figure 6:
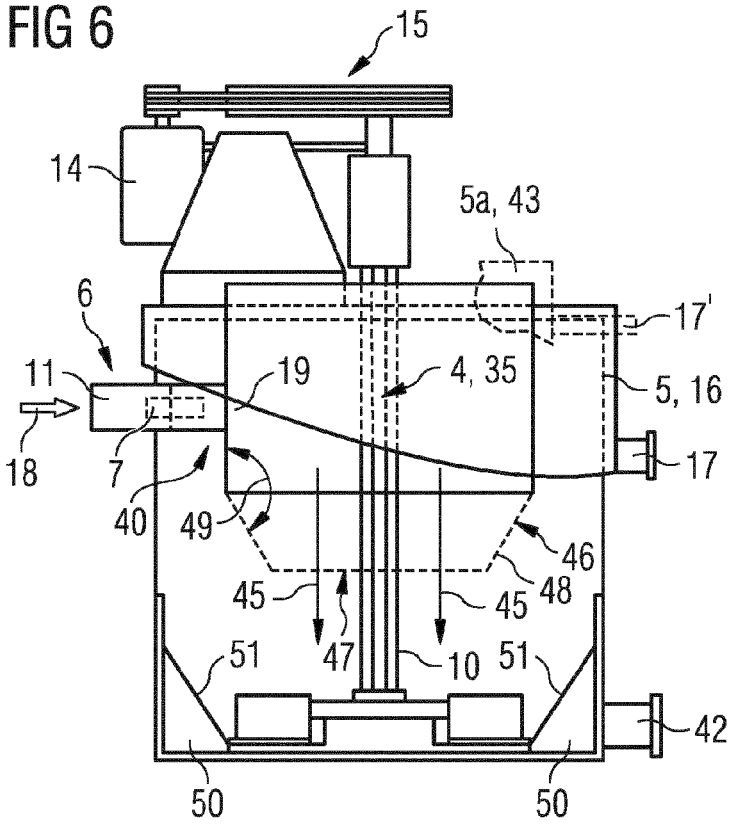
FIG. 6 shows the flotation apparatus of FIG. 5 in a view corresponding to FIG. 2.

An inner chamber 38 is similarly present in the variant of a flotation apparatus 1 shown in FIGS. 5 and 6 also. In this case, however, the charge lines 6 lead, not into the annular space 40, but into the inner chamber 38, passing through the annular space 40. This embodiment is primarily directed at reducing the residence time of the aeroflocs formed in the ejectors 7 of the first flotation stage in the flotation apparatus 1, to 1 to 2 minutes for example. The larger particles of the pulp are conducted through the inner chamber 38 in a targeted manner to the stirrer 3, i.e. are routed to the second flotation stage (indicated by the arrows 45). The residence time of the aeroflocs formed in the turbulence zone 34 or in the second flotation stage lies in the region of 5 to 10 times the residence time of the aeroflocs formed in the first flotation stage. The targeted feeding of the coarser particles from the first flotation stage to the second flotation stage can optionally be accomplished by means of a baffle 46 with adjustable baffle opening 47 arranged at the lower end of the inner chamber 38. The baffle is formed by a conical wall 48 which includes an angle 49 of for example 135° with the sidewall 39 of the inner chamber 38. The adjustability of the baffle opening can be realized e.g. by means of individual movable wall elements overlapping in the circumferential direction of the inner chamber 38. Thanks to the variable baffle opening 47 the stream of coarser particles sinking downward can be conducted to a more or less large central region of the stirrer 3. Overall, the flotation process can be optimized by means of an inner chamber 38 equipped with an adjustable baffle 46. This purpose is also served by an inner chamber 38, with or without baffle 46, which is height-adjustable.

In order to prevent a sedimentary deposition of particles in the corner regions 50 of the flotation chamber 2 that are formed by the lower end section of the sidewall 8 and the base 9, the corner regions are covered by a deflector plate 51 which is embodied in the form of a funnel opening toward the top and laterally encompassing the stirrer 3. A deflector plate of said type may be present in all of the variants of flotation apparatuses 1 described herein.

What is claimed is:

1. A flotation apparatus comprising:

a flotation chamber having a sidewall and a base, upper and lower regions, and serving to contain a pulp, a foam-collecting device arranged in the upper region of the flotation chamber for collecting a foam product formed during the flotation process, and a charge line arranged for continuously charging the upper region of the flotation chamber with pulp, a first mixing device inside the charge line, the first mixing device configured to disperse a gas in the pulp, and a second mixing device located inside the lower region of the flotation chamber and comprising a stirrer and a sparging device introducing the gas into the lower region of the flotation chamber through an interior of the stirrer, wherein the charge line leads into the upper region of the flotation chamber at a point located above the stirrer and above a turbulence zone formed in the pulp by the stirrer.

2. The flotation apparatus of claim 1, further comprising a plurality of charge lines each equipped with a first mixing device arranged on the inside of each charge line serving to feed pulp into the upper region of the flotation chamber and arranged on the flotation chamber in a mutually spaced relationship in a circumferential direction.

3. The flotation apparatus of claim 1, wherein the sidewall of the flotation chamber has a circular cross-sectional shape.

4. The flotation apparatus of claim 3, wherein an end section of the charge line connected to the flotation chamber is aligned tangentially with respect to the sidewall.

5. The flotation apparatus of claim 1, wherein an inner chamber having a cylindrical sidewall and being open at top and bottom is arranged centrally in the flotation chamber with a radial clearance from the sidewall of the flotation chamber while leaving an annular space free.

6. The flotation apparatus of claim 5, further comprising a foam-collecting device arranged in an upper region of the flotation chamber.

7. The flotation apparatus of claim 5, wherein the charge line leads into the annular space.

8. The flotation apparatus of claim 5, wherein the charge line leads into the inner chamber.

9. The flotation apparatus of claim 5, wherein the inner chamber is height-adjustable.

10. The flotation apparatus of claim 5, wherein a baffle with adjustable baffle opening is present at the lower end of the inner chamber.

11. The flotation apparatus of claim 1, wherein the stirrer is encompassed laterally by a deflector plate which is in the form of a funnel opening toward the top and which covers a corner region of the flotation chamber formed by the lower end of the sidewall and the base.

12. The flotation apparatus of claim 1, wherein the foam-collecting device is a collecting tank encompassing the flotation chamber with a radial clearance.

13. The flotation apparatus of claim 1, wherein the foam-collecting device is a collecting tank encompassing the flotation chamber with a radial clearance.

14. The flotation apparatus of claim 1, wherein the first mixing device is an ejector.

15. The flotation apparatus of claim 1, wherein the charge line leads into the flotation chamber at a point disposed above the stirrer close to an upper edge of the sidewall.

16. A flotation method using a flotation apparatus comprising a flotation chamber having a sidewall and a base, upper and lower regions, and serving to contain a pulp, a foam-collecting device arranged in an upper region of the flotation chamber for the purpose of collecting a foam product formed during the flotation process, and a charge line for continuously charging the flotation chamber with pulp, wherein the method is performed in two flotation stages inside a pulp-containing flotation chamber of the flotation apparatus, comprising:

in a first flotation stage, dispersion of a gas in the pulp using a first mixing device arranged inside a charge line serving to feed pulp into the upper region of the flotation chamber, in a second flotation stage, dispersion of the gas in the pulp using a second mixing device comprising a stirrer and a sparging device introducing the gas through an interior of the stirrer, wherein the pulp is fed into the upper region of the flotation chamber at a point located above the stirrer and above a turbulence zone formed in the pulp by the stirrer.

17. The method of claim 16, wherein the first mixing device creates aeroflocs in the first flotation stage forming foam collectable by the foam-collecting device.

* * * * *